US005755641A

United States Patent [19]

Pardella

[11] Patent Number: 5,755,641

[45] Date of Patent: May 26, 1998

[54] STRUCTURAL COMBINATION OF FITTINGS AND TUBULAR MEMBERS AND FASTENER THEREFOR

[76] Inventor: Eugene C. Pardella, 9629 Stamps Ave., Downey, Calif. 90240

[21] Appl. No.: 225,574

[22] Filed: Apr. 11, 1994

Related U.S. Application Data

[62] Division of Ser. No. 49,342, Apr. 21, 1993, Pat. No. 5,326,337.

[51] Int. Cl.[6] ..... A63B 01/00

[52] U.S. Cl. ..... 482/36; 482/23; 482/35; 182/178

[58] Field of Search ..... 403/329, 374, 403/375; 482/36, 23, 33, 35; 273/121; 182/178

[56] References Cited

U.S. PATENT DOCUMENTS

| | | | |
|---|---|---|---|
| 1,471,465 | 10/1923 | Hinton | 482/36 |
| 2,126,636 | 8/1938 | Horne | 482/36 |
| 4,247,216 | 1/1981 | Pansini | 482/109 |
| 4,770,467 | 9/1988 | Zinn | 297/429 |
| 5,400,870 | 3/1995 | Inoue | 182/178 |

FOREIGN PATENT DOCUMENTS

| | | | |
|---|---|---|---|
| 669132 | 8/1963 | Canada | 182/178 |

*Primary Examiner*—Jerome Donnelly
*Attorney, Agent, or Firm*—John T. Matlago

[57] ABSTRACT

Apparatus for fabricating three-dimensional structures for children is provided in which four-way, three-way and elbow fittings having opposing flat sides with orthogonally oriented sockets are used to interconnect cut-to-length tubular members. An end portion of a tubular member is connected to an end portion of a socket by a fastener having a pair of spring loaded opposing pins thereon. The fastener is positioned in a tubular member with its opposing pins protruding out of diametrically opposing holes on the end portion thereof. The end of a tubular member is inserted with a slip fit into a socket until it contacts an internal shoulder thereon and is then rotated until the opposing pins snap into diametrically opposing holes on the end portion of the socket. By using unions in the form of short tubular members to interconnect selected ones of the sockets of fittings, unitary coupling structures are provided having patterns of socket orientations thereon which serve to connect to tubular members or by unions to other sockets as needed to provide a desired three-dimensional structure.

9 Claims, 12 Drawing Sheets

STRUCTURAL COMBINATION OF FITTINGS AND TUBULAR MEMBERS AND FASTENER THEREFOR

This is a division of application Ser. No. 049,342 filed Apr. 21, 1993 now U.S. Pat. No. 5,326,337 issued Jul. 5, 1994.

This invention relates to gymnastic structures for small children and more particularly to an assembly wherein the elements used in the construction thereof can be readily disconnected and replaced by other elements or equivalent accessories to provide a variety of different features thereon.

BACKGROUND OF THE INVENTION

Gymnastic structures provided for children in the past have been heretofore constructed with reticulated structures wherein the elements of the assembly forming three dimensional cells have been lengths of metal pipe provided with reverse threading on the opposite ends thereof which are joined to metal fittings having sockets with reverse threading thereon to form corners of the cells. Such a manner of connecting the elements of the assembly limits the ability of an adult to readily modify the structure of the assembly after it has once been assembled.

SUMMARY OF THE INVENTION

The present invention is directed to a gymnastic assembly for small children that is fabricated of tubular members formed of cut-to-length standard plastic tubing and standard plastic fittings wherein the tubular members are releasably secured within the sockets of fittings by pairs of spring loaded pins.

Accordingly, one of the objects of the present invention is to provide a gymnastic assembly comprised of a plurality of three dimensional cells that can be readily assembled by an adult from cut-to-length standard plastic tubings and fittings, and can from time to time thereafter have selected elements thereof readily disassembled and replaced by other elements and/or preassembled accessories to provide other features thereon of interest to small children.

Another object of the present invention is to provide such a gymnastic assembly that is light in weight and portable thereby enabling it to be easily moved from one location to another in the yard of a home or even into a room of a home.

Another object of the present invention is to provide such a gymnastic assembly having an overall structure that is sufficiently resilient to absorb the shock of sudden contacts made thereon by small children and at the same time is reliable and rigid enough to stand up during the course of play thereon.

These and other objects, features and advantages of the present invention will be made more readily apparent from the following detailed description of the preferred embodiment as illustrated in the accompanying drawings.

DESCRIPTION OF THE PREFERRED EMBODIMENT

Figure 1:
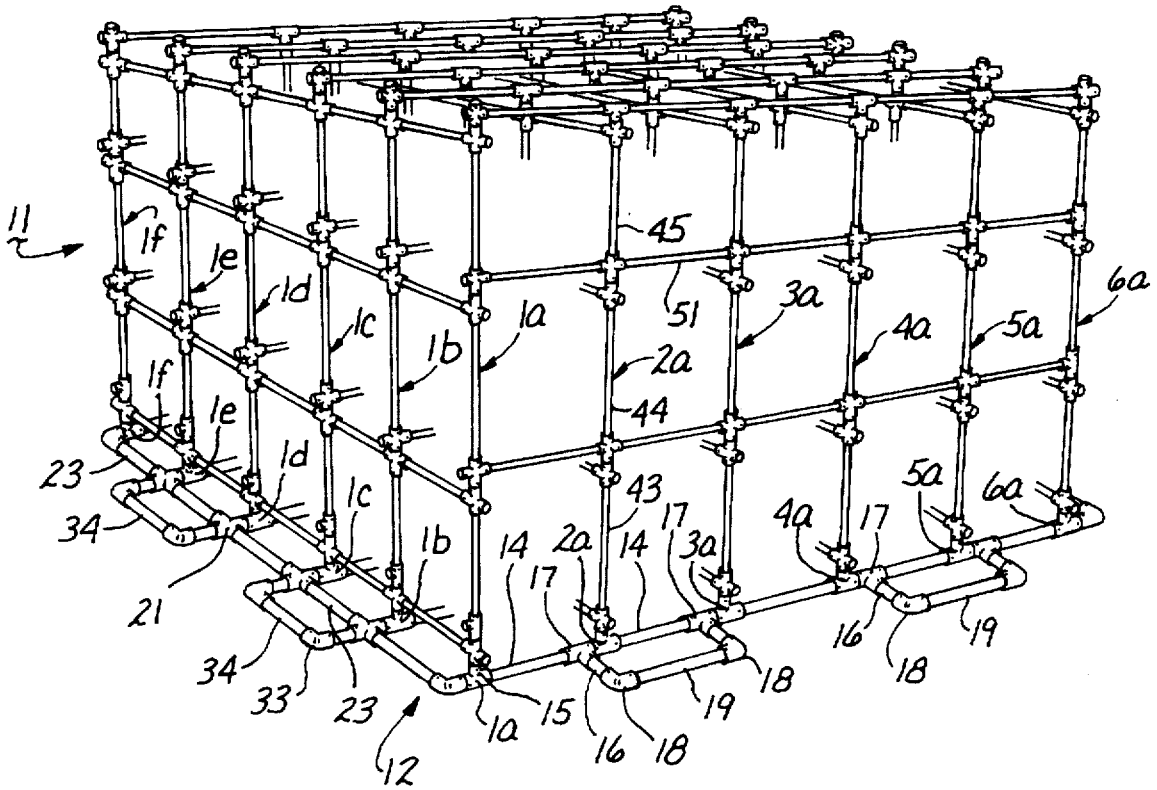
FIG. 1 is an overall perspective view of the outer surface of the gymnastic structure of the present invention.
Figure 2:
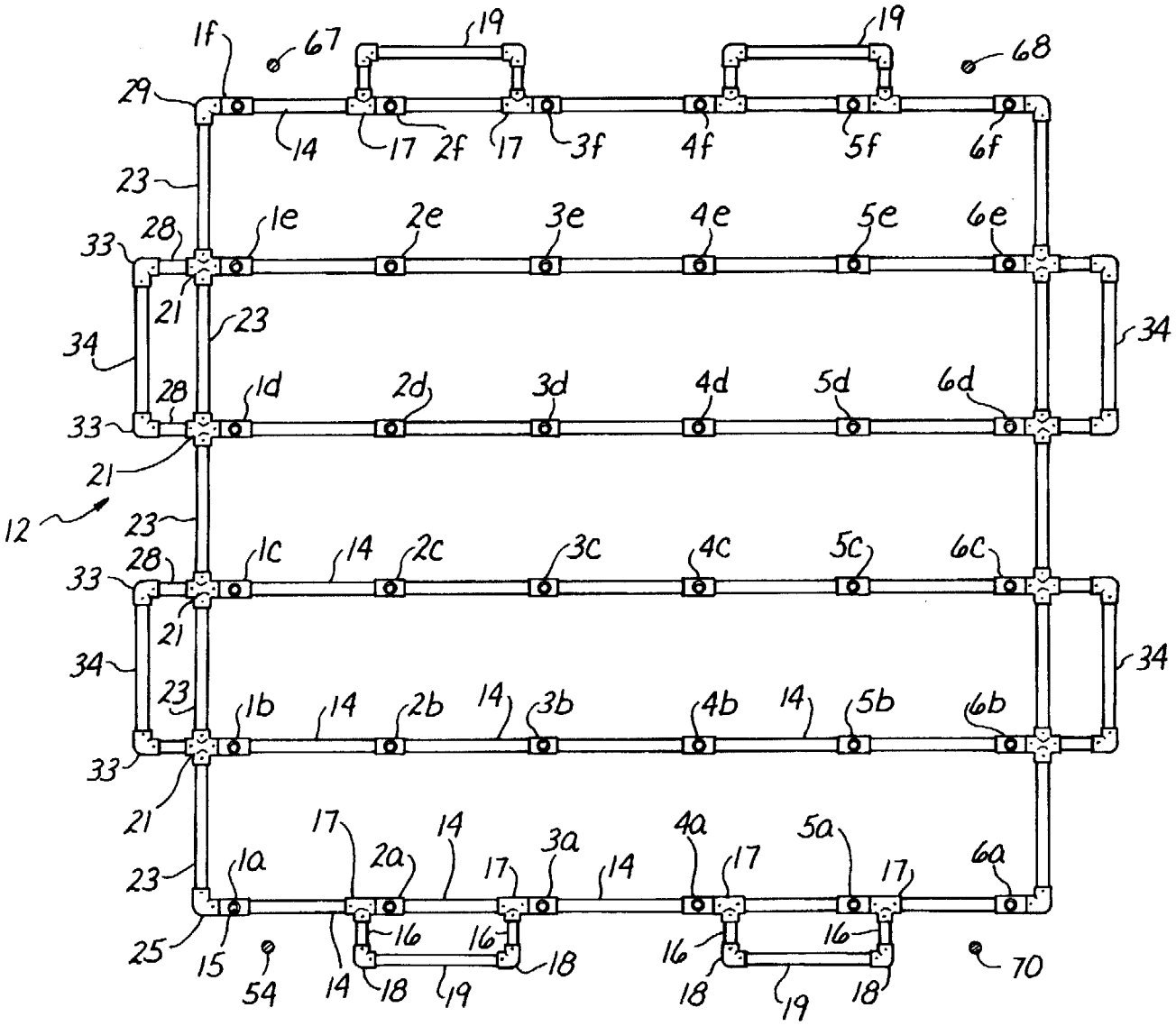
FIG. 2 is an enlarged scale plan view of the bottom support for the gymnastic structure.

Reference will first be made to FIG. 1 which is a perspective view of the overall outer frame 11 of the assembly of the present invention. The outer frame 11 is provided with a base support 12 having an upper plan view as shown in FIG. 2. At the outset, it should be pointed out that the assembly including the outer frame 11, the base support 12, and the internal structure thereof are all formed of standard fittings and tubular members comprised of cut-to-length standard tubing. Both the fittings and the tubing are made of polyvinyl chloride (PVC) plastic. Thus, the front side of the base support 12 is formed along the length thereof with a series of six equally spaced three-way fittings designated 1*a*, 2a, 3a–6a (FIG. 2). Each of these three-way fittings has a ½ inch vertically disposed branch socket, such as the branch socket 15 on the three-way fitting 1a, and ¾ inch horizontally disposed sockets aligned with the bottom front side of the outer frame 11. The horizontal sockets of the series of three-way fittings are interconnected by ¾ inch tubular members 14. It should be noted that the diameters of the branch sockets 15 of these three-way fittings are of a reduced size to enable them to be coupled to sockets of ½ inch fittings provided on the bottoms of a series of uprights, bearing like designations, that form the front side of the outer frame 11. In order to further support the outer frame, the ends of the tubular members 14 adjacent each of the four intermediate three-way fittings 2a, 3a, 4a and 5a along the front side of the base support 12 have a horizontally disposed three-way fitting 17 interposed thereon. Each of the outer branch sockets of these three-way fittings 17 is connected to a short tubular member 16 provided with an elbow fitting 18 on the end thereof so disposed that adjacent pairs thereof are joined by a tubular member 19. As noted in FIG. 2, the structure on the back side of the base support 12, that is comprised of a series of six equally spaced three-way fittings 1f, 2f, 3f–6f, is a mirror image of the front side thereof, and that includes the series of uprights forming the rear side of the outer frame 11 that have their bottom ends coupled to the vertically disposed ½ inch branch sockets of these three-way fittings, and bear like designations.

The left side of the base support 12 is provided along the length thereof with a series of six equally spaced three-way fittings 1a, 1b, 1c–1f. These three-way fittings similarly have ½ inch size vertically disposed branch sockets and have their ¾ inch horizontal sockets extending parallel to the horizontally disposed sockets of the three-way fittings 1a, 2a, 3a, –6a on the front side of the base support 12, i.e., the fittings 1a, 1b, 1c–1f have their horizontally disposed sockets extending normal to the left side of the outer frame 11. As shown in FIG. 1, the reduced size vertically disposed branch sockets of fittings 1a, 1b, 1c–1f on the left side of the base support 12 enable them to be coupled to sockets of ½ inch fittings provided on the bottom ends of a series of uprights, bearing like designations, that form the left side of the outer frame 11. A horizontally disposed four-way fitting 21 is connected by its inner socket to the outer horizontal socket of each of the vertically disposed three-way fittings 1b, 1c, 1d–1e. The horizontally disposed sockets of the four-way fittings 21 that are extending parallel to the left side of the base support 12 are interconnected by ¾ inch tubular members 23. The forward end of the tubular member 23 at the front of the left side of the base support 12 is connected by an elbow fitting 25 to the left socket of three-way fittings 1a. The rearward end of the tubular member 23 at the rear of the left side of the base support 12 is connected by an elbow fitting 29 to the left socket of the three-way fitting 1f. In order to further support the outer frame 11 adjacent ones of the intermediate four-way fittings 21 along the left side of the base support 12 have their outer sockets connected by short tubular members 28 to elbow fittings 33 which are connected together by a tubular member 34. As noted in FIG. 2, the structure on the right side of the base support 12, that is comprised of six equally spaced three-way fittings 6a, 6b, 6c, –6f, is a mirror image on the left side thereof and that includes the series of uprights, bearing like designations, forming the right side of the outer frame 11 that have their bottom ends coupled to the vertically disposed ½ inch branch sockets of these three-way fittings.

Figure 3:
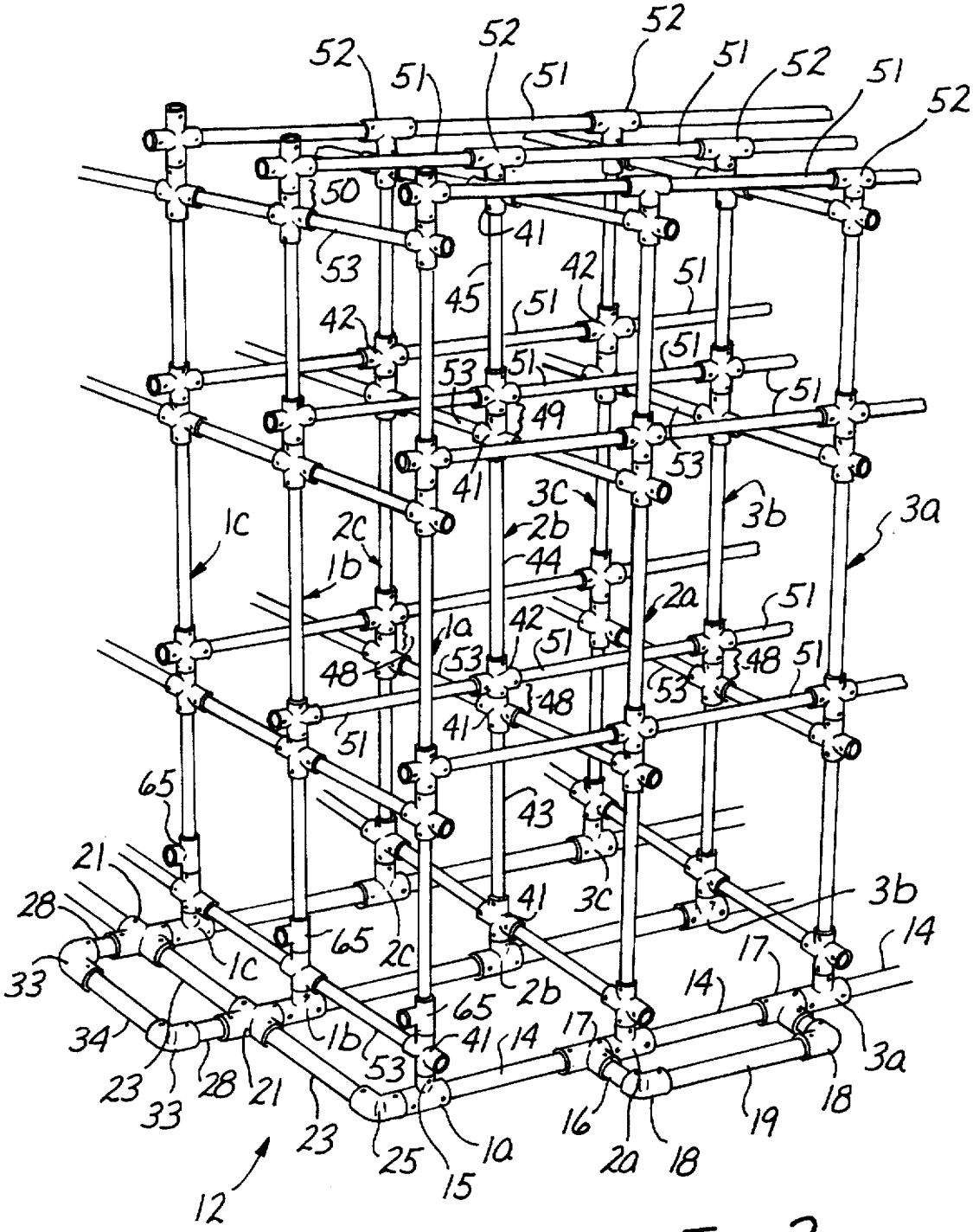
FIG. 3 is an enlarged scale perspective view of a corner portion of the overall assembly in FIG. 1 illustrating the structure of the three dimensional cells provided within the interior thereof.

As further shown in FIG. 2, the three-way fitting 1b, for example, on the left side of the base support 12 is connected by a series of four equally spaced intermediate identical three-way fittings 2b, 3b, 4b and 5b, each interconnected by ¾ inch tubular members 14, to the three-way fitting 6b provided on the right side of the base support 12. Likewise, each of the remaining three-way fittings 1c, 1d and 1e, on the left side of the base support 12 is respectively connected by a similar series of four equally spaced intermediate three-way way fittings, each interconnected by ¾ inch tubular members 14, to the respective three-way fittings 6c, 6d and 6e, on the right side of the base support. Each of these intermediate three-way fittings on the base support 12 have their vertically disposed ½ inch branch sockets coupled to the bottom ends of uprights having like designations, as shown in FIG. 3. It should now be clear from FIG. 2 that base support 12 for the assembly of the present invention comprises six parallel series of six equally spaced three-way fittings extending from the left side to the right side of the base support 12. Moreover, correspondingly positioned three-way fittings in adjacent series are similarly equally spaced from each other. It should be especially noted, as shown in FIG. 2, that all thirty six of the three-way fittings in the six series of three-way fittings have their horizontally disposed sockets extending parallel to the front side of the base support 12. Furthermore, each of these thirty six three-way fittings on the base support 12 has a vertically disposed branch socket of a reduced diameter so that it can be coupled to the bottom end of an upright that bears the same indicia used to designate the three-way fitting on the base support 12.

As best illustrated in FIG. 3, each of these thirty six uprights is comprised of three vertically aligned tubular members, the adjacent ends of which are interconnected by a pair of vertically disposed four-way fittings. Thus, for example, upright 2b in FIG. 3 is comprised of three vertically disposed ½ inch tubular members 43, 44 and 45, each 12 inches long. The lower end of tubular member 43 of upright 2b is connected to the upper socket of a four-way fitting 41, the lower socket of which is connected to the vertical branch socket of three-way fitting 2b. The upper end of tubular member 43 of upright 2b is coupled to the lower end of tubular member 44 by way of a lower intermediate level corner joint 48 comprised of lower and upper vertically disposed four-way fitting 41 and 42 having their adjacent vertical sockets connected together. The connection is such that the lower four-way fitting 41 has its horizontal sockets extending parallel to the left side of the outer frame and the upper four-way fitting 42 has its horizontal sockets extending parallel to the front side of the outer frame. Likewise, the upper end of tubular member 44 of upright 2b is coupled to the lower end of tubular member 45 by way of an upper intermediate level corner joint 49 which is comprised of a pair of lower and upper four-way fittings 41 and 42 identical to the corner joint 48. Finally, the upper end of tubular member 45 of upright 2b is connected to an upper terminating corner joint 50 comprised of a lower vertically disposed four-way fitting 41 having its horizontal sockets extending parallel to the left side of the outer frame and an upper vertically disposed three-way fitting 52 having its horizontal sockets extending parallel to the front side of the frame.

Figure 5:
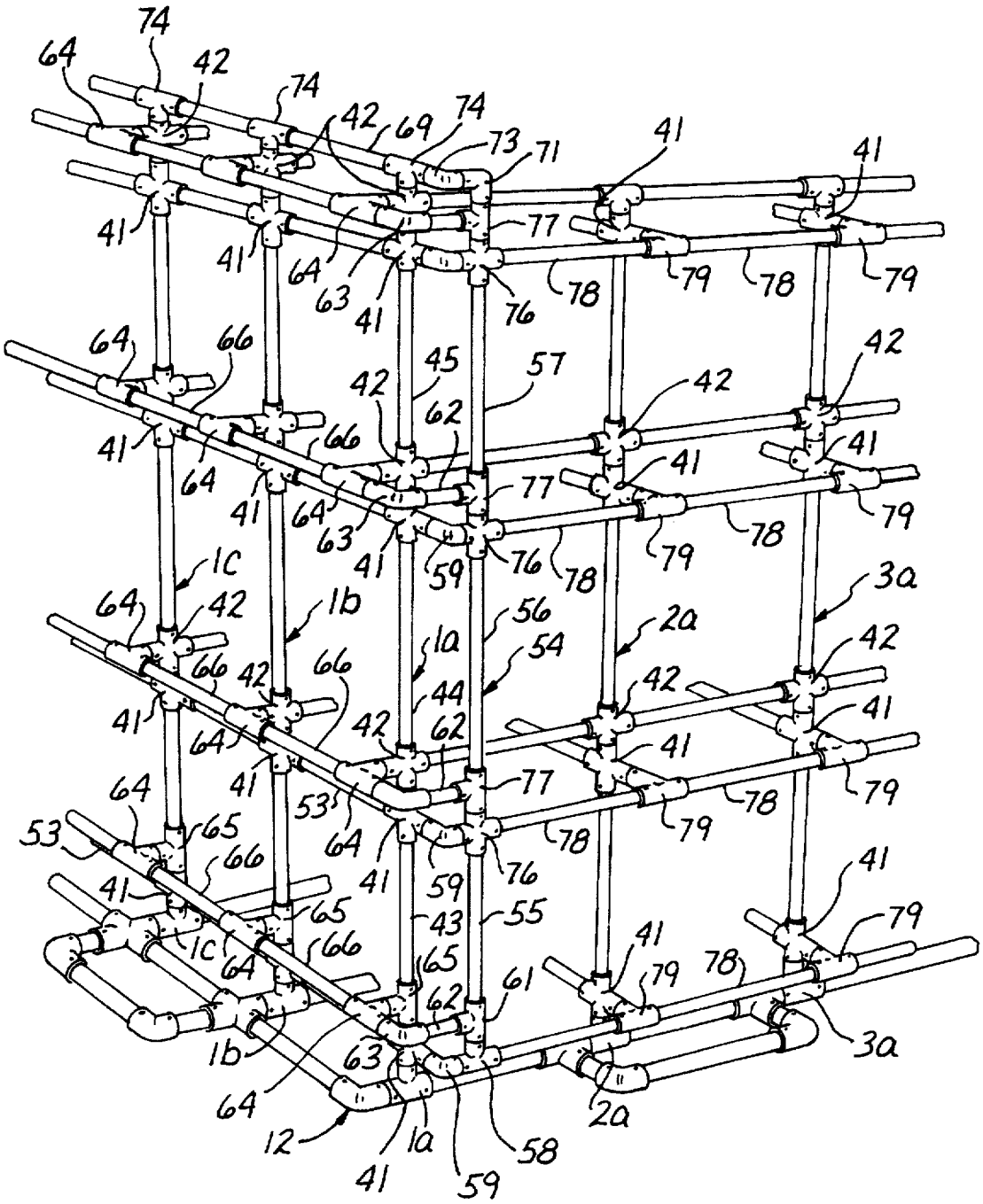
FIG. 5 is an enlarged scale perspective view of a corner portion of the outer frame of the overall assembly in FIG. 1 illustrating the bracing structure provided thereon.

It should now be clearly understood that, except for the fittings provided on the upper and lower terminating ends of the uprights extending along the left and right sides of the outer frame 12, the structure of all thirty six uprights comprising the assembly are identical to upright 2b. As will be subsequently described in connection with FIG. 5, the different fittings provided at the upper and lower terminating ends of these left and right side uprights serve to mount the bracing structure provided on all four sides of the outer frame 11 of the assembly (FIG. 5).

Having described the structure of each of the thirty six uprights that extend upwardly from each of the thirty six three-way fittings provided on the base support 12, next to be described are the horizontal tubular members and the cross horizontal tubular members that are provided between the corner joints 48, 49 and 50 of each of the uprights at the respective lower and upper intermediate levels and the top levels thereof for defining the three levels of cells within the overall assembly, namely the bottom, middle and top cells.

Thus, all of the uprights lying in a plane parallel to the front side of the outer frame (see FIG. 3), such as the plane defined by the series of six uprights 1*b*, 2*b*, 3*b*–6*b*, for example, have the horizontal sockets of the upper four-way fittings 42 on each of their intermediate corner joints 48 and 49, and the horizontal sockets of the upper three-way fittings 52 on each of their top corner joints 50, interconnected by horizontal tubular members 51 that are each 12 inches long. Moreover, corresponding uprights that are located in adjacent planes, such as uprights 2*b* and 2*c*, and 3*b* and 3*c*, for example, have the cross horizontal sockets of the lower four-way fittings 41 located on each of their bottom ends, intermediate corner joints 48 and 49, and top corner joints 50, interconnected by cross horizontal tubular members 53 that are each 12 inches long. The formation of each of these cells within the assembly in this manner is best seen in FIG. 4 which is a perspective view of a middle cell in the interior of the assembly.

Figure 4:
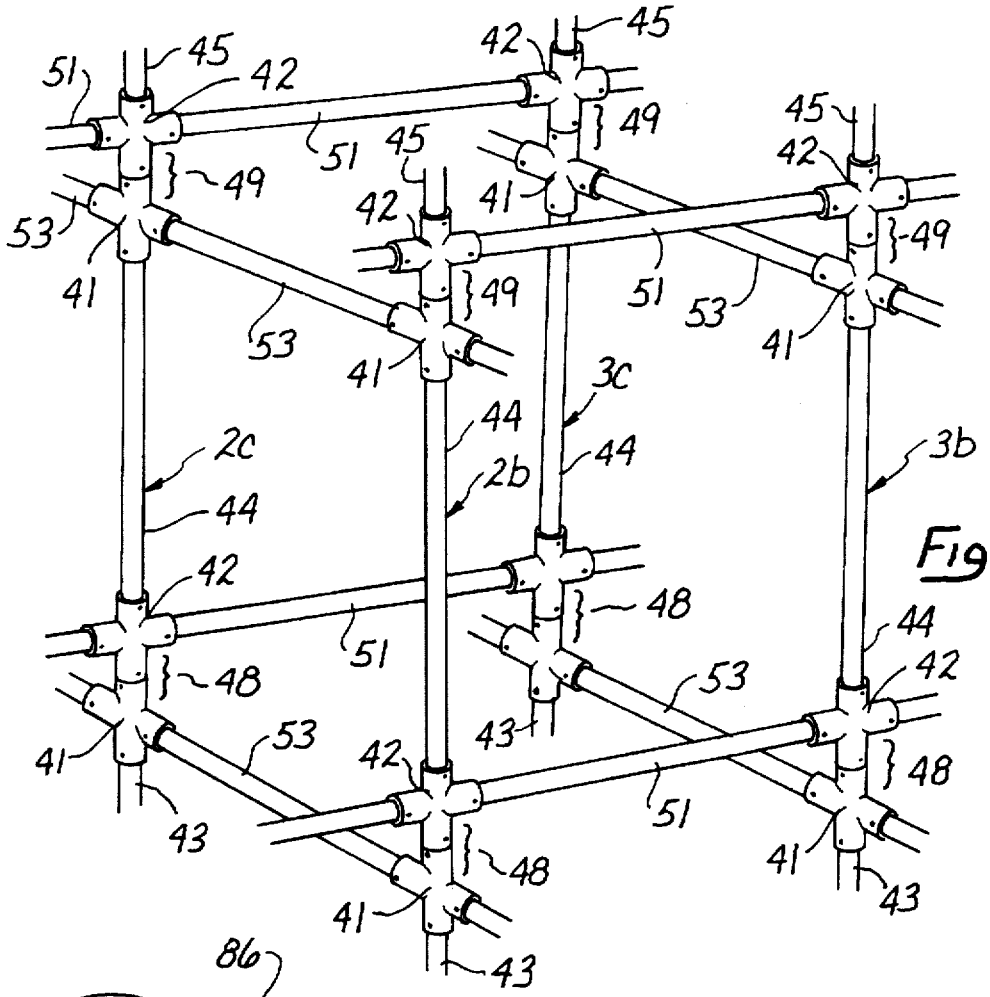
FIG. 4 is a perspective view of a three dimensional cell formed within the interior of the overall assembly.

It should be especially noted in FIG. 4 that as a result of the middle cells of the assembly being formed by connecting the horizontal sockets of the upper four-way fittings 42 of the corner joints 48 and 49 at the front and rear sides thereof by horizontal tubular members 51 and by connecting the horizontal sockets of the lower four-way fittings 41 of corner joints 48 and 49 at the left and right sides thereof by cross horizontal tubular members 53, each of the middle cells is defined by windows on the left and right sides thereof which are at a lower position than the windows on the front and rear sides thereof.

It should be clearly understood that by interconnecting the corner joints of adjacent uprights in a plane by horizontal tubular members 51 and by interconnecting the corner joints of corresponding uprights in adjacent planes by cross horizontal tubular members 53, three levels of cells, each cell having a square plan view, are provided in the assembly and since each level provides 25 cells, 75 cells are formed within the interior of the outer frame 11 of the assembly.

Each of the middle and top cells of the assembly is identical to the cell shown in FIG. 4, differing only by the top cells having a different upper terminating fitting on their corner joints 50. The bottom cells of the assembly differ because of the need to adapt the bottom terminating ends of the uprights to the base support 12 which is comprised of horizontally disposed sockets of vertically three-way fittings that all extend parallel to the front plane of the assembly.

Reference will next be made to FIG. 5 which, similarly to FIG. 3, shows on an enlarged scale a corner portion of the outer frame of the assembly in FIG. 1. The internal structure of the assembly that is shown in FIG. 3 is omitted in FIG. 5 in order to clarify the showing of the bracing structure that is provided on all four side surfaces of the outer frame 11.

The bracing structure includes the adding of an auxiliary upright 54 on the front side of the outer frame 11 adjacent the corner front left corner upright 1*a*. Auxiliary upright 54 is formed of three lengths of tubular members 55, 56 and 57 identical to the three lengths of tubular members 43, 44 and 45 forming the corner upright 1*a*. However, the auxiliary upright 54 differs by having adjacent horizontally disposed and vertically disposed three-way fittings 58 and 61 at its lower terminating end; a vertically disposed four-way fitting 76 and three-way fitting 77 at each of its lower and upper intermediate levels; and a vertically disposed four-way fitting 76, a three-way fitting 77, and a terminating elbow 71 at its terminating top level. It should be noted that all the horizontal sockets of the fittings on the auxiliary upright 54 extend parallel to the front plane of the assembly. The bracing structure provides for connecting the horizontal socket of the lower level three-way fitting 58 on the auxiliary upright 54 by an elbow 59 to the horizontal socket of the lower four-way fitting 41 connected to the vertical socket of three-way fitting 1*a* of the base support 12 to which the bottom of the corner upright 1*a* is connected. Moreover, the horizontal branch socket of the upper vertically disposed three-way fitting 61 at the lower level of the auxiliary upright 54 is connected by a short tubular member 62 and an elbow 63 to the horizontal socket of a three-way fitting 64 that is connected by its branch socket to the branch socket of a vertically disposed upper three-way fitting 65 provided on the corner upright 1*a*. To provide further bracing, the horizontal sockets of the three-way fittings 64 at locations 1*a*, 1*b*, 1*c*–1*f* along the lower level of the left side of the outer frame, are interconnected by tubular members 66. Inasmuch as the rear left corner of the assembly is a mirror image of the front left corner thereof shown in FIG. 5, after the series of connections to the horizontal socket of fitting 64 on the lower level of the rear left corner upright 1*f* (FIG. 2) of the outer frame 11, the lower level of the rear left corner upright 1*f* is, in turn, connected to the bottom of another auxiliary upright 67 provided on the rear left side of the assembly (illustrated in FIG. 2) by structure which is identical to that connecting the front left corner upright 1*a* to the auxiliary upright 54. As shown in FIG. 5, the auxiliary upright 54 and the front left corner upright 1*a* are connected together at each of the lower and upper intermediate levels and the top level thereof by the same bracing structure described for the lower level, and the bracing structure extends along the left side of the outer frame at each of these levels to connect to the rear left side auxiliary upright 67, as described for the lower level. As shown in FIG. 5, the top level of the auxiliary upright 54 differs only in that, in addition to the bracing structure so far described for all the levels of the auxiliary upright 54 along the left side of the outer frame, an elbow 71 having a horizontal socket which is parallel to the front of the outer frame is connected above the vertically disposed three-way fitting 77 on the terminating end of auxiliary upright 54. Elbow 71 is further connected to an elbow 73 having a horizontal socket which is parallel to the left side and is connected by tubular members 69 to successive horizontal sockets of three-way fittings 74, each having a lower branch socket coupled to the top socket of four-way fittings 42 provided on each of the uprights along the left side of the outer frame. The rear left corner upright 1*f* is then similarly connected by use of an elbow (not shown) to the auxiliary upright 67 (FIG. 2) located on the rear left side of the outer frame 11 just inward from the corner upright 1*f*.

The front side of the outer frame 11 is further braced by interconnecting the horizontal sockets of the three-way fitting 58 provided on the bottom of the auxiliary upright 54 and the four-way fittings 76 provided on the auxiliary upright 54 at the lower and upper intermediate and top levels thereof by horizontal tubular members 78 to the horizontal sockets of three-way fittings 79 connected by their branch sockets to horizontal sockets of four-way fittings 41 provided at each of these levels on the uprights 2*a*, 3*a*, 4*a* and 5*a* extending along the front side of the outer frame 11. The horizontal sockets of the three-way fittings 79 connected to the four-way fittings 41 provided at each of the levels of upright 5*a* is further connected to the socket of the horizontally disposed three-way fitting on the bottom terminating end of an auxiliary upright 70 located adjacent the front right side corner of the outer frame as illustrated in FIG. 2. Moreover, the front right corner upright 6*a* (FIG. 2) is connected at each of its intermediate and top levels to the front right auxiliary upright 70 by structure which is a mirror image of that used to connect the front left corner upright 1*a* to the front left auxiliary upright 54. The rear side of the outer frame which is provided with an auxiliary upright 67 near the left corner upright 1*f* and an auxiliary upright 68 near the right corner upright 6*f* thereof is connected by a bracing structure at each of its levels that is a mirror image of the front side.

Next to be described is the structure employed in the assembly to releasably secure the tubular members within the sockets of the fittings so that they can be readily disconnected by an adult.

Figure 6:
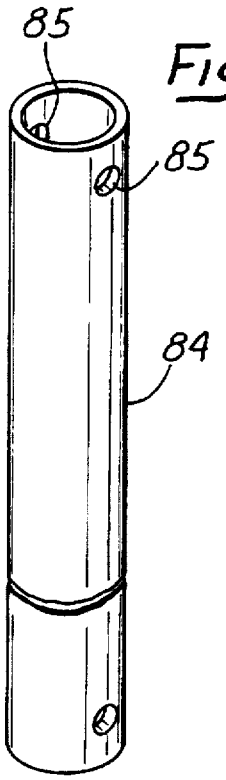
FIG. 6 is a perspective view of a tubular member provided with a pair of opposing holes on each end portion thereof.

In order to fully understand the overall assembly structure of the present invention, it should be noted that all the types of component parts that are used in its fabrication are shown in FIGS. 6 to 12. These include cut-to-length standard ½ inch and ¾ inch polyvinyl chloride (PVC) plastic tubings, referred to as tubular members, as generally shown in FIG. 6, and standard ½ inch and ¾ inch PVC plastic four-way fittings, three-way fittings, and elbow fittings, as shown in FIGS. 9, 10, 11 and 12. The cut-to-length standard ½ inch and ¾ inch tubings include the short tubular members or unions which are used to couple sockets on a pair of fittings together such that the ends of the sockets contact each other.

Note that tubular member 84 shown in FIG. 6 has a pair of diametrically opposing holes 85 in each of the end portions of the wall thereof. Moreover, each of the fittings shown in FIGS. 9, 10, 11 and 12 has opposing holes on the end portions of the walls of the sockets thereof and these opposing holes on the sockets of the fittings are located on the flat sides of the fittings.

Figure 8:
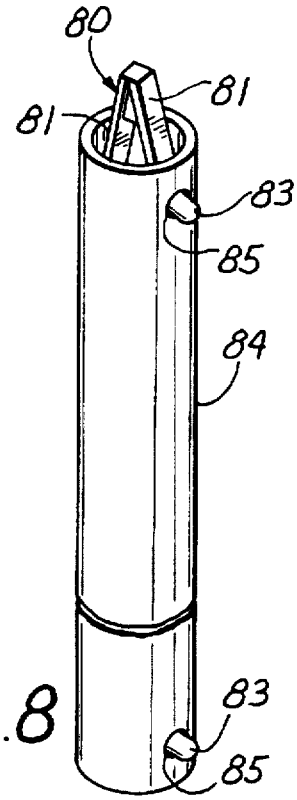
FIG. 8 is a perspective view of a tubular member having a pair of pins on the V shaped fastener inserted in the opposing holes on the end portions thereof.
Figure 7:
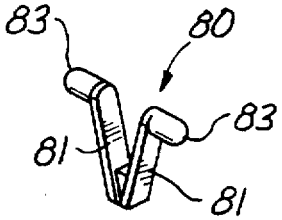
FIG. 7 is a perspective view of a V shaped fastener provided with a pair of pins for securing a tubular member within the socket of a fitting.
Figure 12:
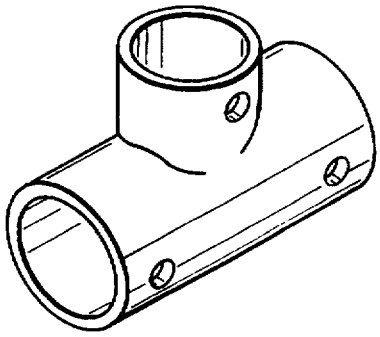
FIG. 12 is a perspective view of a three-way fitting having a branch socket with a smaller diameter than the other sockets thereof and provided with opposing holes on the sockets thereof.

As shown in FIG. 7, a V shaped fastener 80 molded of PVC plastic is provided with a pair of arms 81 that are joined at one end thereof and have a pair of outwardly projecting pins 83 integrally formed on the free ends of the arms. Since the plastic material is resilient, the free ends of the arms 81 can be moved toward each other by manually applying an inward pressure on them. This enables the pair of pins 83 on the ends of the compressed arms to be inserted into the end of a tubular member 84 having opposing holes on the end portion thereof, as shown in FIG. 6, and positioned therein with the pair of pins 83 respectively engaged in the opposing holes 85 on the end portion thereof, as shown in FIG. 8. When the pins 83 are so held they protrude out of the opposing holes 85 beyond the outer wall of the tubular member.

It should be noted the V shaped fastener 80 can be inserted on the end of tubular member 84 so that when the pins 83 on the ends of the arms extend through the opposing holes 85, the arms 81 will either extend out of the end of the tubular member as shown on one end of the tubular member in FIG. 8, or the arms 81 will be enclosed within the tubular member as shown on the other end of the tubular member in FIG. 8.

Figure 9:
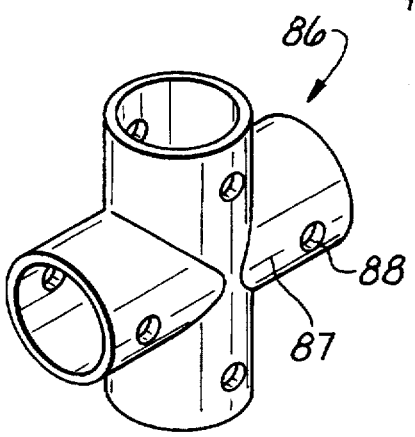
FIG. 9 is a perspective view of a four-way fitting provided with opposing holes on the sockets thereof.
Figure 10:
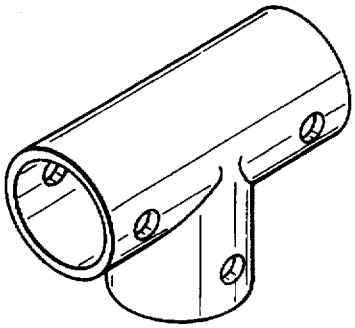
FIG. 10 is a perspective view of a three-way fitting provided with opposing holes on the sockets thereof.
Figure 11:
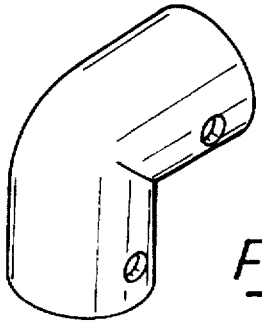
FIG. 11 is a perspective view of an elbow fitting provided with opposing holes on the sockets thereof.
Figure 13:
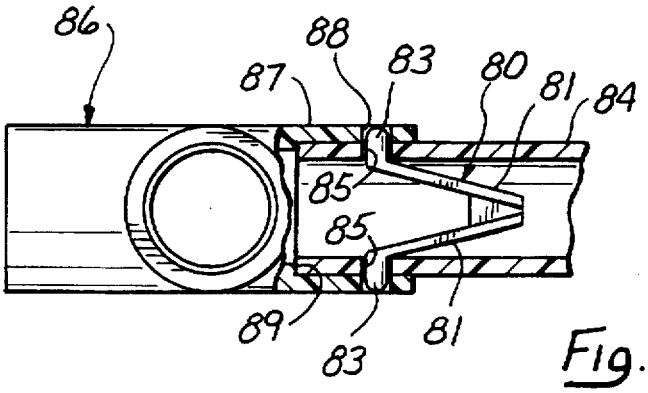
FIG. 13 is a partially sectional view showing an end portion of a tubular member secured within a socket of a fitting by the pair of pins provided on a V shaped fastener.

FIG. 13 shows the tubular member 84 secured within the socket 87 of the four-way fitting 86. It should be noted that V shaped fastener 80, shown in FIG. 7, is positioned in the tubular member 84 with its arms 81 fully enclosed therein. The opposing pins 83 on the ends of the arms 81 protrude out of the opposing holes 85 on the end portion of the tubular member so as to extend into the opposing holes 88 on the end portion of the socket 87 of the four-way fitting 86 (FIG. 9). The end portion of the tubular member 84 is thus held by the opposing pins 83 within the socket 87 of the four-way fitting 86.

It should now be clearly understood that in order to insert the end of the tubular member 84 into the socket 87 of the four-way fitting 86, the pins 83 residing in the holes 85 on the end portion of the tubular member 84 need to be depressed by the forefinger and thumb of one hand. This enables the end of the tubular member 84 to be inserted with a slip fit into the cylindrical opening of socket 87 on fitting 86 until it contacts the internal shoulder 89 thereof. The tubular member is then rotated within the socket until the ends of the opposing pins 83 snap into the opposing holes 88 provided on the end wall portion of the socket of the fitting 86, thereby securing the tubular member 84 within the socket 87 on fitting 86. It should be noted that the ends of the pins 83 are approximately flush with the outer wall of the socket 87. Preferably the pins are within three to eight thousandths of an inch smaller in diameter than the holes in the sockets of the fittings so as to have a relatively close fit therein.

Moreover, in order to disconnect the tubular member 84 from the socket 87 of the four-way fitting 86, one of the pins 83 positioned in the opposing holes 88 on the socket 87 is first depressed by use of the blunt end of an instrument until it is flush with the outer wall of the tubular member 84. Then, by slightly rotating the tubular member 84 relative to the socket, the pin 83 is caused to be held in its depressed position within the socket 87 by its outer edge engaging the bottom edge of the hole in the socket. The opposing pin 83 is then depressed by the blunt end of the instrument until it is flush with the outer wall of the tubular member 84. Then, by further rotating the tubular member, the outer ends of both the pins 83 are now free of the holes 88 in the socket 87 thereby enabling the tubular member 84 to be withdrawn from the socket. However, because the other end of the tubular member 84 is being held in a socket on an adjacent upright, for example, it is necessary for one to grasp the adjacent uprights by his hands and pull them apart to enable the end of the tubular member 84 to be free of the socket 87.

It should now be clear that the present interconnect means provides a readily modifiable assembly of elements which makes it possible for the end portion of a tubular member in the assembly to be disconnected therefrom by an adult and replaced by another identical tubular member, or by an equivalent tubular member having other structure built into it.

Figure 14:
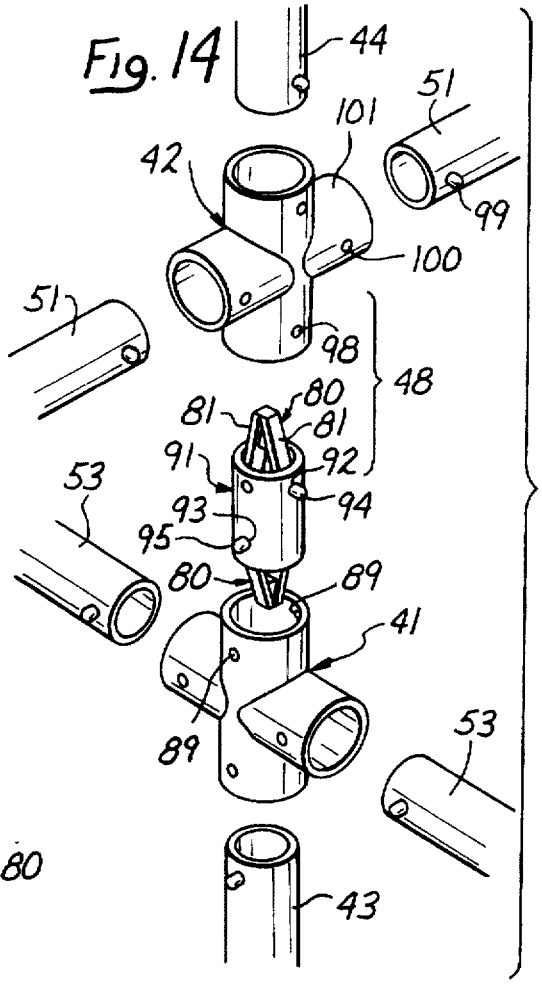
FIG. 14 is an exploded view of the elements forming a corner joint of a cell located within the interior of the assembly.

Reference will next be made to FIG. 14 which shows an exploded view of a corner joint 48 as provided at the lower intermediate level of each of the uprights of the assembly as previously described in connection with FIG. 3.

Figure 16:
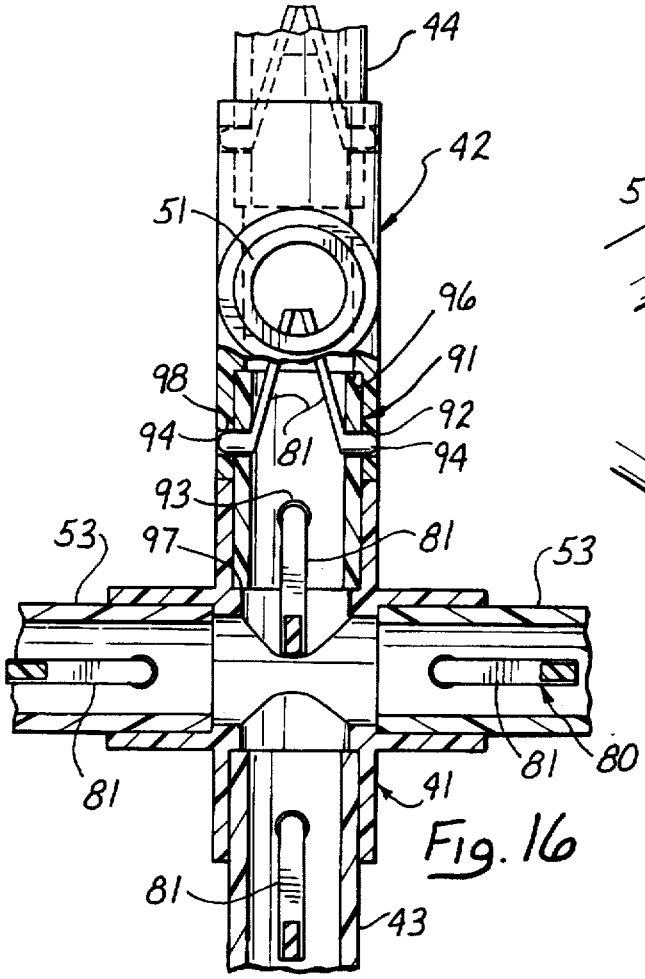
FIG. 16 is a partial cross sectional view showing of FIG. 15 as taken along line 16—16 thereof.

Thus corner joint 48 comprises an upper four-way fitting 42 and a lower four-way fitting 41 both disposed to provide vertically aligned sockets. The sockets of both fittings have opposing holes in the end portions thereof, such as opposing holes 98 on the bottom vertical socket of the upper four-way fitting 42. Note that these opposing holes are on the flat sides of the fitting. Positioned between the vertical sockets of the fittings is a union 91 which is a short tubular member having a pair of opposing holes 92 on the upper end wall portion thereof and a pair of opposing holes 93 on the lower end wall portion thereof. The pairs of opposing holes 92 and on the upper and lower end wall portions of the union 91 are located on diameters that are at 90 degrees relative to each other. Moreover, the union 91 has a pair of pins 94 of a first V shaped fastener 80 engaged in its upper opposing holes 92 and a pair of pins 95 of a second V shaped fastener engaged in its lower opposing holes 93. The fasteners 80 are inserted in the ends of the union such that their arms 81 extend out of the ends thereof. Upon manually inwardly depressing the pins 94 in the upper end holes of the union 91, the upper end wall portion thereof can be slipped into the bottom vertical socket of the upper four-way fittings 42 until it contacts the internal shoulder 96 thereof (FIG. 16). The union 91 is then rotated in the socket until the pins 94 snap into the opposing holes 98 of the socket. Similarly, upon manually depressing the pins 95 in the lower end holes 93 of the union 91, the lower end wall portion thereof can be slipped into the top vertical socket of the lower four-way fitting 41 until it contacts the internal shoulder 97 thereof (FIG. 16). The union 91 is then rotated in the sockets until the pins 95 snap into the opposing holes 89 of the socket. It should now be clear, as shown in FIG. 15, that the pair of upper and lower four-way fittings 42 and 41 are coupled together by their vertical sockets such that the horizontal sockets on the upper four-way fitting 42 are oriented at 90° with respect to the horizontal sockets of the lower four-way fitting 41.

Figure 15:
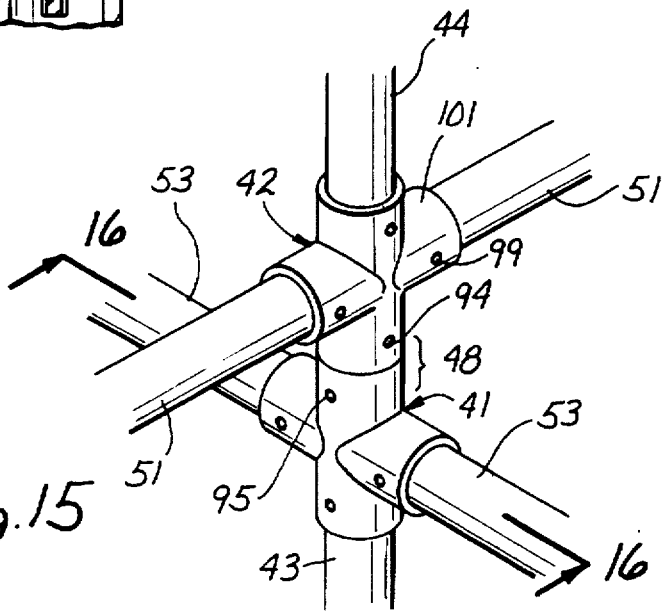
FIG. 15 is a perspective view of the assembled pair of fittings in FIG. 14 showing the horizontal sockets thereof oriented at 90° with respect to each other.

As further shown in FIGS. 14 and 15, horizontal tubular members 51, being used to interconnect horizontal sockets of the four-way fittings 42 of the corner joints, such as corner joint 48, on adjacent uprights, have a V shaped fastener (FIG. 7) inserted in each end thereof with the pair of opposing pins 99 on the free ends of the arms of the V shaped fastener 80 lying within the interior of the tubular member 51. By depressing the pair of pins 99, the end of the tubular member 51 can be slipped into the end of the socket 101 of four-way fitting 42 and seated therein against the internal shoulder thereof and then rotated until the pair of pins 99 snap into the opposing holes 100 on the socket. FIG. 15 which is a perspective view of the assembled components shown in FIG. 14, shows the end of a horizontal tubular member 51 connected to the horizontal sockets on either end of the upper four-way fitting 42 and shows the end of a cross horizontal tubular member 53 connected to the horizontal socket on either end of the lower four-way fitting 41. As seen in FIG. 16, which is a partial cross sectional view of the assembled corner joint 48 as taken along line 16—16 of FIG. 15, the arms 81 of the V shaped fasteners 80 reside within the interior of the respective end portions of tubular members 53.

It should now be understood that when children are playing on the assembly as thus far described, the vertical loads on the horizontal tubular members 51 and the cross horizontal tubular members 53 are supported by the sockets of the fittings in which their end portions reside. Likewise, the vertical loads on the vertical tubular members, such as vertical tubular members 44 of an upright, are supported by the internal annular shoulder of the sockets of the fittings in which the bottom ends of the vertical tubular members reside. Thus it should now be clear that the function of the opposing pins is to make sure that the end portions of the tubular members will be retained within the sockets of the fittings until it is desired to withdraw them from the sockets in order to modify the assembly as will be described hereinafter.

It should be especially noted that the use of a pair of spring-loaded pins for mechanically axially locking the end portions of the tubular members within the sockets of the fittings can be made without compromising the necessary rigidity of the overall structure of the assembly, especially in view of the bracing structure provided on the surface of the outer frame as shown in FIG. 5.

It should also be pointed out that when applicant's locking pin interconnect is used there is a slightly axial movement present at each of the interconnecting joints of the assembled structure. This axial movement is due to the fact that the mechanical interconnections being used naturally require a small clearance between the pins and the holes in the tubular members and the sockets. Since all the large number of horizontal tubular members and fittings in the assembled structures are interconnected in the same mechanical manner, the total movement between the many tubular members and fittings accumulate, when two adjacent uprights in the assembly are pulled away from each other, for example, to enable the end portion of a horizontally disposed tubular member to be removed from the horizontal socket of a fitting and replaced by another equivalent horizontal tubular member. In fact, the assembly made by interconnecting the tubular members to the sockets of the fittings in this manner further serves to absorb shocks or sudden forces that may be placed thereon during use and thus assures that such shocks or impacts are less likely to cause harm to children playing thereon.

Other advantages of using PVC plastic material for forming the cut-to-length tubular members and to mold the fittings is that these members and fittings are strong and light weight standard parts readily available on the market. Also, the PVC plastic material can be made to have a green, yellow or orange color, for example, which is attractive to children. Moreover, PVC plastic material can be made with an ultra violet inhibitor therein which assures that the structure will not weaken structurally when exposed to sunlight for long periods of time as when used in the back yard of a home.

It should now be understood that the assembled structure as now described can be used by children between two to five years of age, for climbing. However, as children grow and their bodies change they desire different and more challenging things to do on their gymnastic structure. Accordingly, because of the manner of releasably interconnecting the tubular members and fittings in the assembly together by use of spring loaded locking pins, the assembly can be readily modified by an adult from time-to-time to provide other features thereon of interest to children.

Figure 17:
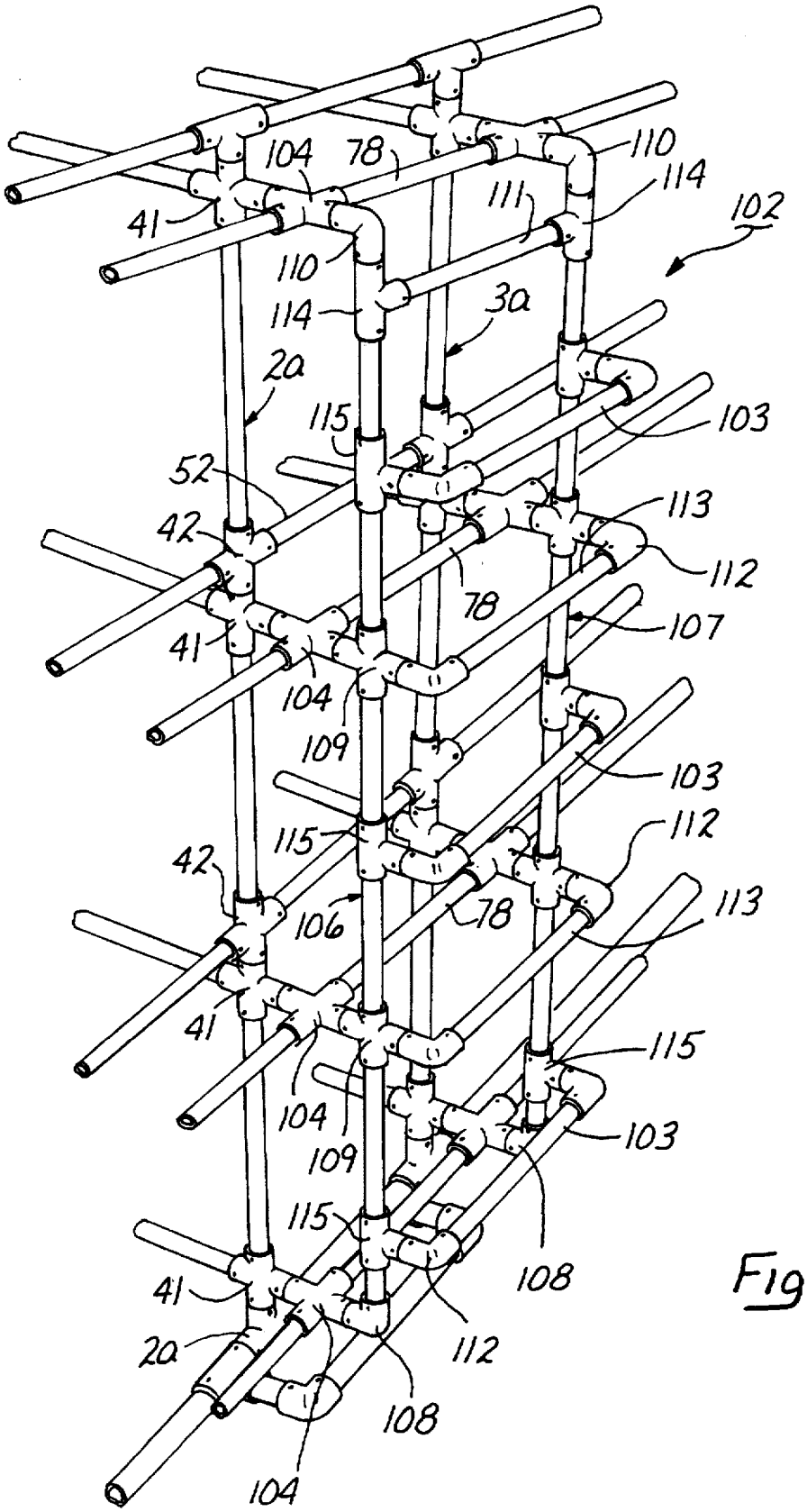
FIG. 17 shows a preassembled ladder mounted on the modified front portion of the outer frame provided with bracing structure thereon.

Thus, reference will next be made to FIG. 17 which shows a separate preassembled ladder 102 for small children fabricated of tubular members made of cut-to-length standard plastic tubing and standard plastic fittings connected together by use of spring loaded locking pins, as heretofore described, to fabricate the climbing structure assembly.

The ladder is constructed so that it can be mounted on the modified front side wall of the assembly provided with the bracing structure thereon, as previously described in connection with FIG. 5.

The ladder includes a pair of side posts 106 and 107, each comprised of lengths of vertical tubular members interconnected by vertically disposed fittings located at successively higher levels thereon. Thus, each side post is provided with an elbow fitting 108 on the terminating bottom thereof, a vertically disposed four-way fitting 109 at locations thereon corresponding to the lower and upper intermediate levels of the assembly, and an elbow fitting 110 at the terminating top thereof. The outer horizontal sockets of the four-way fittings 109 at the same level on the posts 106 and 107 are connected to elbow fittings 112 disposed to provide opposing horizontal sockets interconnected by horizontal tubular members 113 which serve to provide steps for the ladder. Additional steps for the ladder are provided by interposing vertically disposed three-way fittings 115 on the vertical tubular members forming posts 106 and 107 at locations thereon that are half way between the bottom of the assembly and the lower intermediate level thereof, half way between the lower and upper intermediate levels thereof, and half way between the upper intermediate level and the top of the assembly. The outer branch sockets of the three-way fittings 115 at the same level on the posts 106 and 107 are connected to elbows 112 disposed to provide opposing horizontal sockets which are interconnected by horizontal tubular members 103 that serve to provide additional steps on the ladder. Thus, the ladder is provided with steps that are spaced apart half the distance provided by the successive horizontal climbing members 51, for example, on the main assembly. A top step 111 for the ladder 102 is provided by interposing vertically disposed three-way fittings 114 on the vertical tubular members comprising the posts 106 and 107 at a location half way between the upper intermediate level and the ceiling of the assembly. This step is formed by positioning the vertically disposed three-way fittings 114 such that their branch sockets oppose each other and are interconnected by a tubular member 111.

As evident by referring to FIG. 5, in order to mount the ladder 102, as above described, on the front side of the assembly provided with the bracing structure thereon, the horizontal three-way fittings 79 located at the bottom, the lower intermediate level, the upper intermediate level, and the top level of the uprights 2*a* and 3*a* of the assembly are removed from the four-way fittings 41 provided on these uprights. Of course, this requires that the ends of the horizontal tubular members 78 of the bracing structure be removed from the horizontal sockets of the three-way fittings 79. Then a horizontally disposed four-way fitting 104 is inserted in place of the three-way fitting 79 at each of the four levels on uprights 2*a* and 3*a* (See FIG. 17) and the horizontal tubular members 78 are placed back into the horizontal sockets of the four-way fittings 104 now on the uprights 2*a* and 2*b*. The ladder is then connected by the inner sockets of its four-way fittings 109 at the lower and upper intermediate levels of its posts to the outer sockets of the four-way fitting 104 now provided at each of these levels on the uprights 2*a* and 3*a*. Moreover, the elbow fittings 108 and 110 on the bottom and top the posts 106 and 107 are connected to the outer sockets of the four-way fittings 104 on the bottom and top of uprights 2*a* and 3*a*.

Figure 18:
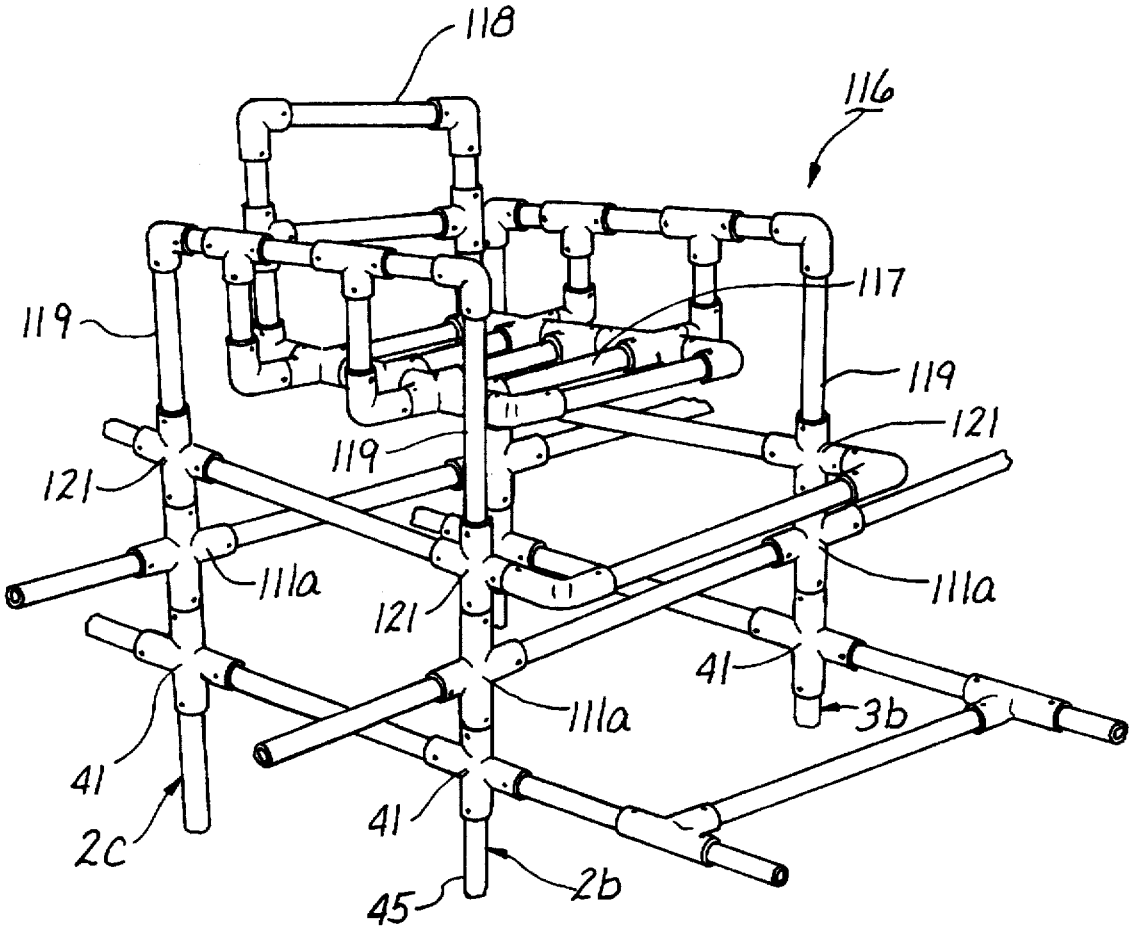
FIG. 18 shows a preassembled chair mounted on the top of a cell of the assembly by modifying a portion of the ceiling thereof as shown in FIG. 3.

As shown in FIG. 18, a chair 116 can be mounted on the ceiling (FIG. 3) of the assembly just inward from the uprights 2*a* and 3*a* to which the ladder 102 is attached. To do this, the four three-way fittings 52 on the ceiling of the assembly which correspond to the upper ends of a top cell defined by uprights 2*b*, 3*b* and 2*c*, 3*c* are replaced by four four-way fittings 111*a* as shown in FIG. 18. Then the chair 116, which has been previously assembled, by use of cut-to-length tubular members joined to appropriate fittings by locking pins, is comprised of a seat 117, a back 118 for the seat, and four corner legs 119 as shown in FIG. 18. The four legs 119 are provided with a vertically disposed four-way fittings 121 on the bottom ends thereof. Note that the four legs 119 are spaced to conform to the spacing of the vertically disposed four-way fittings 111*a* on the upper end of the top cell. The four legs 119 are then mounted by connecting the lower sockets of their four-way fittings 121 by the use of unions to the upper vertical sockets of each of the four-way fittings 111*a* previously provided on the upper ends of uprights 2*b*, 3*b* and 2*c*, 3*c*.

Figure 19:
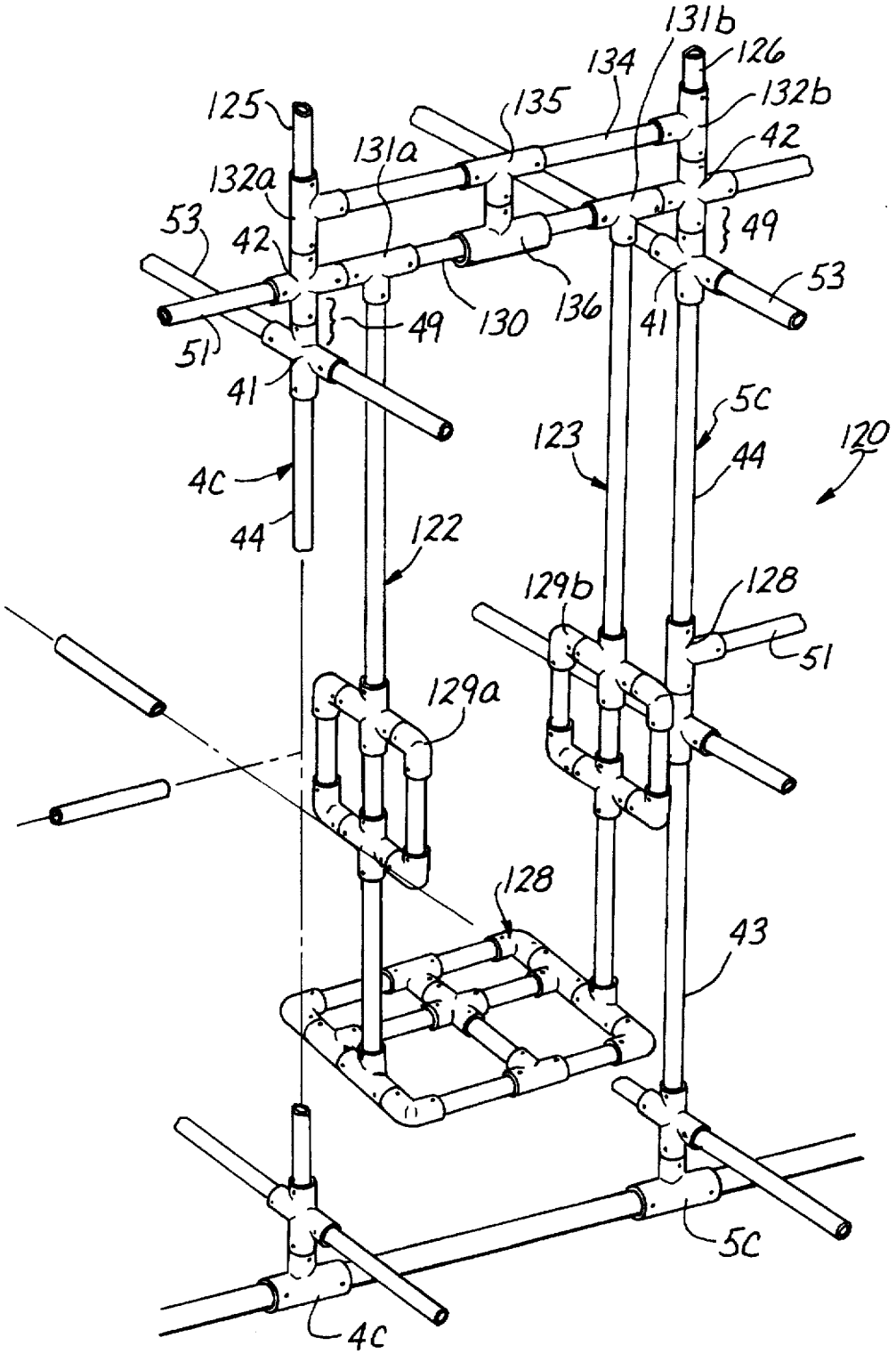
FIG. 19 shows a preassembled swing having side poles pivotally suspended from a modified upper horizontal tubular member of a middle cell of the assembly such that the swing can travel through an alleyway formed therein.

Reference will next be made to FIG. 19 which shows a swing 120 separately fabricated by use of tubular members made of cut-to-length standard plastic tubings and standard plastic fittings interconnected by use of locking pins, as previously described.

The swing 120 includes a pair of side shafts 122 and 123 formed of tubular members with bottom ends connected to the sides of seat 128. The side shafts 122 and 123 have shoulder rests 129*a* and 129*b* formed thereon at a location above the seat.

In order to mount the swing 120 within the assembly, it is necessary to modify the structure of the assembly by removing the horizontal tubular member 51 supported between the four-way fittings 42 on the respective uprights 4*c* and 5*c* (see FIGS. 2 and 3) at the upper intermediate level thereof, and replacing it by a horizontal tubular member 130 having horizontal three-way fittings 131*a* and 131*b* joined on the respective ends thereof. The outer horizontal socket of each of the three-way fittings 131*a* and 131*b* is then joined to a union whose outer end portion freely rotates within the inner socket of the four-way fitting 42 provided at the upper intermediate level on uprights 4*c* and 5*c*. It should be noted that the ½ inch horizontal tubular member 130 has the horizontal sockets of a ¾ inch three-way fitting 136 freely positioned thereon midway of the ends of tubular member 130. It is necessary to further modify the assembly by removing the upper vertical tubular members 45 of the uprights 4*c* and 5*c* above the four-way fittings 42 (FIG. 3) at the upper intermediate level thereof and inserting in place thereof vertical tubular members 125 and 126 having vertical three-way fittings 132*a* and 132*b* joined to the respective bottoms thereof. The branch sockets of the three-way fittings 132*a* and 132*b* are coupled by unions to the upper sockets of the four-way fittings 42 at the upper intermediate levels of uprights 4*c* and 5*c*. The horizontal sockets of the three-way fittings 132*a* and 132*b* on the uprights 4*c* and 5*c* are interconnected by the outer ends of horizontal tubular members 134 having their inner ends connected by a centrally located horizontal three-way fitting 135.

The upper reduced diameter branch socket of the three-way fitting 136 which has its horizontal sockets loosely fitted on the horizontal tubular member 130 is then coupled by a union to the downwardly depending branch socket of the three-way fitting 135, thereby providing further support for the tubular member 130 which is being used to support the swing.

It should also be noted that it is necessary to still further modify the assembly to provide an alleyway therethrough by removing the upper horizontal tubular members 51 at the lower intermediate level between each of the uprights 4*c* and 5*c*, 4*b* and 5*b*, and 4*d* and 5*d*; and, further, to replace the four-way fittings 42 at each of these locations by three-way fittings 127. This latter modification is needed to remove the inner sockets of the four-way fittings 42 which if left, could cause harm to the body of a child as he moves therepast while sitting on the swing.

With the assembly modified as described above, the upper tubular ends of the side shafts 122 and 123 of the swing can now be connected within the branch sockets of the three-way fittings 131*a* and 131*b*, respectively, and held therein by the locking pins, as hereinbefore described.

Figure 20:
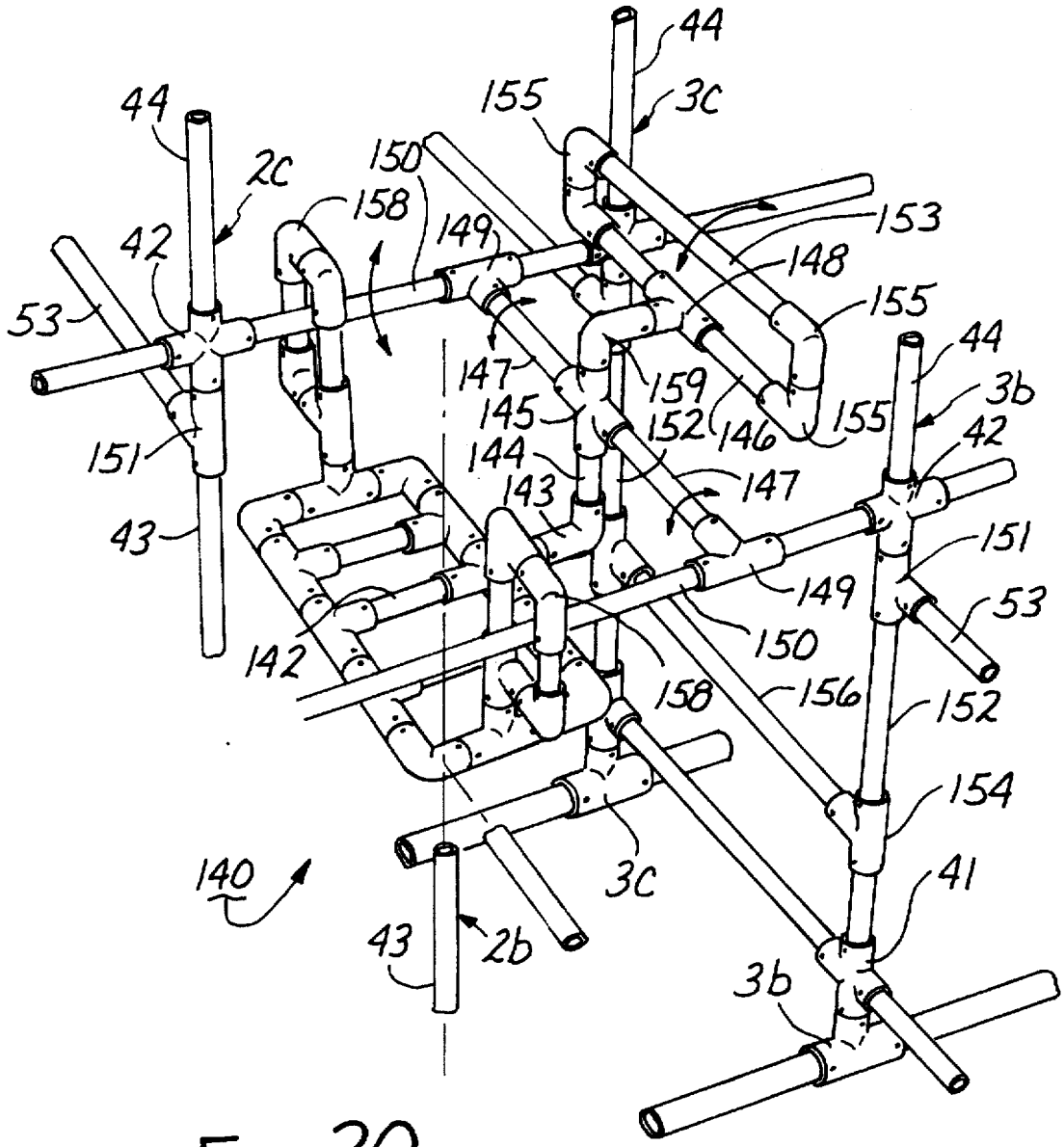
FIG. 20 shows a preassembled rocking chair mounted within a modified interior lower cell of the assembly.

Reference will next be made to FIG. 20 which shows a separately assembled rocking chair 140 for use by a child. The rocking chair is fabricated of tubular members formed of cut-to-length standard plastic tubing joined to appropriate standard plastic fittings and held together by locking pins, to provide a seat 142 having its front end connected by a forwardly extending elbow fitting 143 and a short vertical tubular member 144 to the bottom socket of a central vertically disposed four-way fitting 145. Each of the side sockets of the four-way fitting 145 has the inner end of a side support horizontal tubular member 147 connected thereto. A cross horizontal tubular member 153, which serves as a hand bar, is provided with a pair of elbow fittings 155 on each side thereof that are connected by inwardly directed lower horizontal tubular members 146 to horizontal sockets of a central horizontally disposed three-way fitting 148 having its branch socket connected by an elbow 159 to the top socket of the central four-way fitting 145. A rectangular limit structure 158 is attached on each side of the seat 142.

To enable the rocking chair 140 to be mounted within a bottom cell of the assembly (see FIGS. 2 and 3) defined by uprights **2*b*, 3*b* and 2*c*, 3*c*, for example, the horizontal tubular members 51 normally provided between the four-way fittings 42 at the lower intermediate level of uprights 2*c* and 3*c* and uprights 2*b* and 3*b*, are replaced by horizontal tubular members 150 each having a three-way fitting 149 that is interposed thereon closer to the uprights 3*b* and 3*c*. Moreover, the cross horizontal tubular members 53 normally provided between the four-way fittings 41 at the lower intermediate level of the uprights 3*b* and 3*c* and 2*b* and 2*c* are removed and the four-way fittings 41 normally provided at these locations are also replaced by the three-way fittings 151. In addition the bottom vertical tubular members 43 comprising the uprights 3*c* and 3*b* are removed and replaced by vertical tubular members 152 having three-way fittings 154 interposed thereon at a level above the bottom of the cell. A horizontal cross tubular member 156 which serves as a foot rest is then held within the branch sockets of the three-way fittings 154**.

With the above modifications made to a bottom cell of the assembly, the preassembled rocking chair 140 is mounted across the two horizontal tubular members 150 on the top of the bottom cell by inserting the outer end portions of the tubular members 147 provided on either side of its central four-way fitting 145 into the branch sockets of the three-way fittings 149 on the two horizontal tubular members 150. It should be noted that no locking pins are provided on the end portions of the tubular members 147, thereby enabling the end portions thereof to freely rotate within these branch sockets. Also the rectangular limit structures 158 provided on either side of the seat 142 are assembled so that the horizontal tubular members 150 of the rocking chair extend therethrough.

When a child sits in the seat 142 with his legs straddling the forwardly extending elbow fitting 143, his feet resting on the lower cross horizontal tubular member 156 provided between uprights **3*b* and 3*c*, and his hands holding on to the front cross horizontal tubular member 153, by pushing on the cross horizontal tubular member 156 with his feet, the child can cause the seat 142 to rock back and forth for a short distance controlled by the vertical openings of the side rectangular limit structures 158**.

Figure 21:
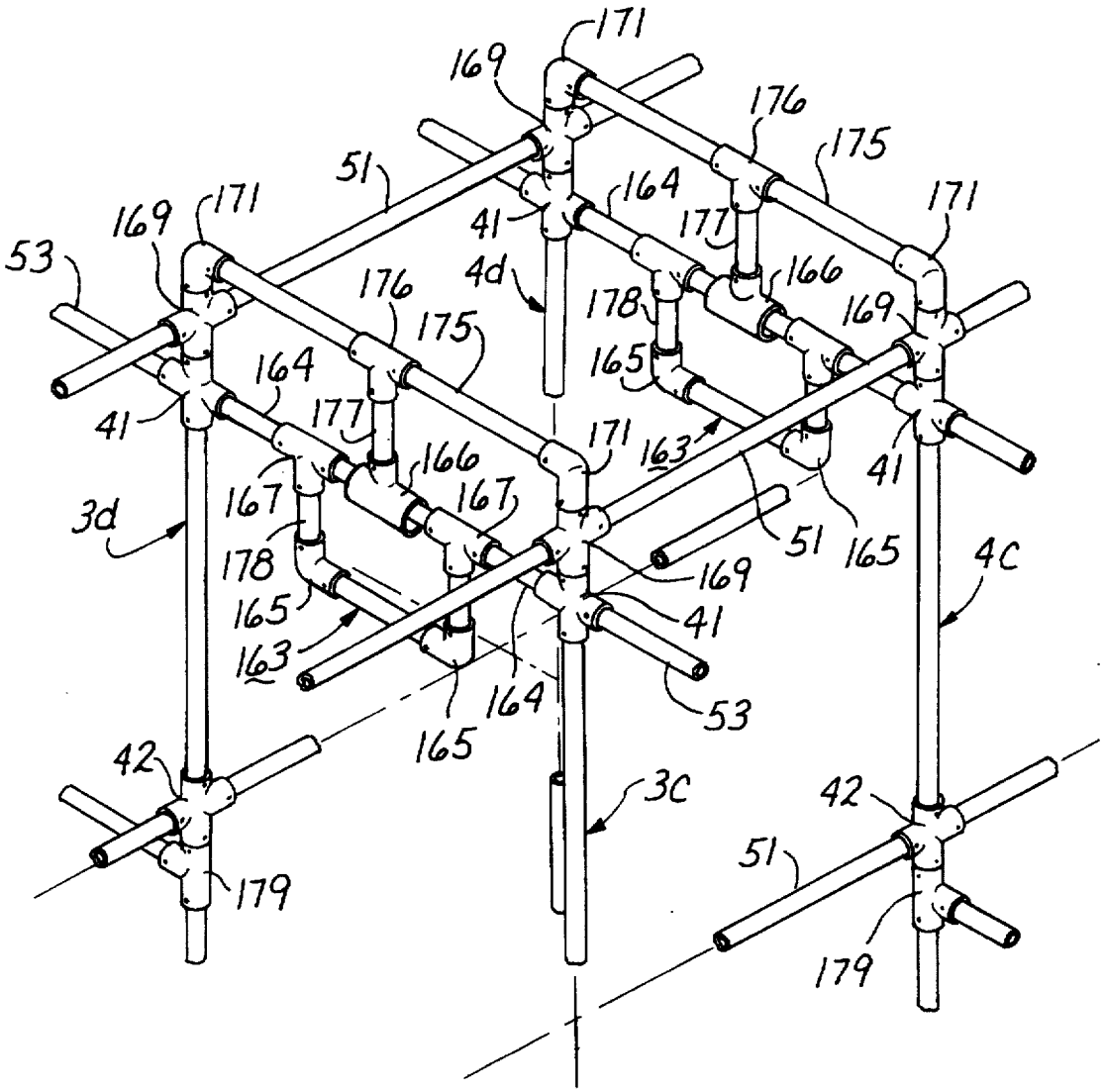
FIG. 21 shows the internal structure of the assembly modified to enable an alleyway to be formed therethrough with swinging hang bars suspended from successive modified cross horizontal tubular members provided along the top of the alley-way.

Reference will next be made to FIG. 21 which shows a series of swinging hang bars 163 connected to cross horizontal tubular support members 164 provided on the ceiling of an alleyway extending through the assembly. Only the uprights **3*c*, 4*c* and 3*d*, 4*d* of the adjacent series of uprights 1*c* through 6*c* and 1*d* through 6*d*, which form the sides of the alleyway in the assembly, are shown in FIG. 21**. The uprights of these series that are not shown are identical to those shown.

Thus, in order to be able to mount the hang bars 163, it is necessary to modify the assembly by removing the cross horizontal tubular members 53 (FIG. 3) normally connecting the opposing inner sockets of the four-way fittings 41 provided at the upper ends of the corresponding uprights **1*c* through 6*c* and 1*d* through 6*d*. Then the cross horizontal tubular support member 164 having a three-way fitting 167 connected on either side of the middle portion thereof has its outer ends supported to freely rotate within the opposing inner sockets of the four-way fittings 41 provided at the upper ends of the corresponding uprights 1*c* through 6*c* and 1*d* through 6*d*. Note also that a three-way fitting 166 having ¾ inch horizontal sockets is positioned to freely encircle the middle portion of the cross horizontal tubular support member 164** which is comprised of ½ inch tubing.

The ceiling of the assembly is further modified by replacing the three-way fitting 52 normally provided on the assembly at the top of the uprights **2*a* through 5*a* (FIG. 3) with four-way fittings 169. Elbow fittings 171 having opposing sockets are then joined to the top sockets of the four-way fittings 169 on each of the uprights 1*a* through 6*a* and 1*b* through 6*b*. Then a cross horizontal tubular support member 175 having a horizontally disposed three-way fitting 176 with a downwardly extending branch socket interconnected on the middle thereof has its ends connected to the opposing sockets of the elbow fittings 171 on the corresponding uprights. The upper reduced diameter branch socket of the three-way fitting 166 is then connected to the downwardly depending branch socket of the three-way fitting 176 by a short tubular member 177**.

The assembly is further modified to provide an unobstructed alleyway from one side to the other thereon by removing the four-way fittings 41 provided at the upper end lower intermediate levels of each of the uprights **1*c* through 6*c* and 1*d* through 6*d*, and replacing them by three-way fittings 179**. This eliminates the projecting horizontal sockets on the four-way fittings previously provided at these levels.

The hang bars 163 are then connected by their side elbows 165 to the lower ends of short tubular members 178 having their upper ends connected to the branch sockets of the pair of three-way fittings 167 provided on the successive cross horizontal tubular members 164 extending along the ceiling of the alleyway from one side of the assembly to the other. Thus a child can climb on the successive horizontal tubular members 51 and/or cross horizontal tubular members 53 provided at the various levels of the assembly to a level at which he can grasp a hang bar 163 and then swing from one hang bar 163 to the next as he travels from one end of the alleyway to the other.

Although the foregoing disclosure has been concerned with a particular exemplary embodiment, it is to be understood that the invention is susceptible of many modifications and variations in both the construction and arrangement thereof. The invention, therefore, is not limited to the specific disclosure provided herein, but is to be considered as including all modifications and variations coming within the scope of the invention as defined in the appended claims.

What is claimed is:

1. Apparatus for use in fabricating toys for children comprising:

a plurality of fittings having sockets thereon, said fittings being limited to four-way fittings, three-way fittings and elbow fittings, each said fitting characterized by having the sockets thereon disposed in a common plane such that each of the fittings has opposite flat sides;

each of the sockets on the fittings provided with opposing holes on the outer end portions thereof that are located on diameters thereof that have the same orientation when viewed from the end of the socket and each said socket having an internal shoulder spaced inwardly of the opposing holes thereon;

a plurality of tubular members, each made of a cut-to-length tubing, each of the tubular members having diametrically opposing holes on the opposite end portions thereof wherein a portion of the tubular members have opposing holes on the opposite end portion thereof that are oriented on diameters that are at right angles relative to each other and the remaining tubular members have opposing holes on the opposite end portions thereof that are oriented on diameters that are parallel to each other;

a plurality of V shaped fasteners, each fastener comprising a pair of resilient arms having opposing pins on the ends thereof inserted in each of the opposite end portions of the plurality of tubular members with the opposing pins thereon protruding out of the opposing holes thereon;

whereby the end portion of a tubular member can be inserted into a socket of a fitting with the end thereof abutting the internal shoulder thereof and rotated therein until the opposing pins on the arms of the v shaped fastener snap into the opposing holes on the socket to thereby secure the tubular member within the socket; and a three-dimensional assembly fabricated by interconnecting aligned sockets of two of said fittings by inserting the opposite end portions of a cut-to-length tubular member in each of said aligned sockets of said two fittings and securing the end portions of the tubular member in the aligned sockets by the use of the V shaped fastener in each of the end portions of the tubular member, and wherein when the opposing holes on the end portions of the tubular member are on diameters that are at right angles relative to each other, the sockets on each of the two fittings being joined that are normal to the aligned socket thereof are at right angles relative to each other when viewed from the end of the aligned socket and when the opposing holes on the end portions of the tubular member are on diameters that are parallel to each other, the sockets on each of the respective fittings are normal to each other when viewed from the end of the aligned sockets, and wherein each of the remaining sockets on each of the two fittings are external sockets that can each be similarly aligned with a socket of any of said plurality of fittings and interconnected by inserting the opposite end portions of another cut-to-length tubular member having V shaped fasteners in the opposite end portions thereof to fabricate an assembly of a three-dimensional toy.

2. Apparatus for fabricating an assembly for use by children comprising, in combination:

a first and second fitting, each fitting characterized by having sockets thereon disposed in a common plane so that each fitting has opposite substantially flat sides, and each fitting has at least two sockets thereon that are perpendicular to each other;

each of said sockets on said fittings having diametrically opposing holes on the outer end portion thereof that are located on diameters thereof that have the same orientation and an internal shoulder spaced inwardly of the opposing holes thereon;

a union formed of a short cut-to-length tubing having diametrically opposing holes on each end portion thereof;

a fastener for each end portion of the union, each fastener formed of a pair of diverging resilient arms, said arms having adjacent ends thereof joined and having spaced apart free ends provided with opposing outwardly extending pins thereon;

said fastener positioned in each end portion of the union with the opposing pins on the free ends of the arms thereof extending radially through and protruding out of the opposing holes thereon;

said union having its end portions connected in respective aligned sockets of the first and second fittings by depressing the opposing pins on the end portions thereof and inserting the end of the union with a slip fit into the socket until it contacts the internal shoulder thereof and then rotating the union with respect to the socket until the depressed opposing pins on the end portion of the union snap into the opposing holes on the outer end portion of the socket;

wherein said union provides for uniting aligned sockets of the first and second fittings so that the ends of the aligned sockets are substantially in contact with each other, thereby forming a unitary coupling structure with the remaining sockets of the first and second fittings being external sockets which are at right angles to the aligned sockets and provide connections for the assembly.

3. The combination as recited in claim 2 wherein the diametrically opposing holes on the respective end portions of the union are located on diameters thereof that are parallel to each other;

whereby when the union provides for uniting aligned sockets of the respective fittings, the sockets of the respective fittings that are perpendicular to the aligned sockets thereof are offset from each other and when viewed from the end of the aligned sockets are oriented so as to be parallel to each other.

4. The combination as recited in claim 2 wherein the diametrically opposing holes on the respective end portions of the union are located on diameters thereof that are at an angle with respect to each other;

whereby when the union provides for uniting aligned sockets of the respective fittings, the sockets of the respective fittings that are perpendicular to the aligned sockets thereof are offset from each other and when viewed from the end of the aligned sockets are oriented so as to be at said angle with respect to each other.

5. The combination as recited in claim 2, wherein the diametrically opposing holes on the respective end portions of the union are located on diameters thereof that are at a right angle with respect to each other;

whereby when the union provides for uniting aligned sockets of the respective fittings, the sockets of the respective fittings that are perpendicular to the aligned sockets thereof are offset from each other and when viewed from the end of the aligned sockets are oriented so as to be at a right angle with respect to each other.

6. The combination as recited in claim 2 wherein both said first and second fittings are four-way fittings, each said fitting having two pairs of sockets thereon with each pair being normal to the other;

wherein the diametrically opposing holes on the end portions of the union are located on diameters thereof that are at a predetermined angle with respect to each other; and wherein the unitary structure so formed has six external sockets thereon; and wherein the sockets of the respective fittings that are perpendicular to the aligned sockets thereof are offset from each other and when viewed from the end of the aligned sockets are oriented at an angle relative to each other corresponding to the angle at which the diameters of the diametrically opposing holes on the end portions of the union are located relative to each other.

7. The combination as recited in claim 2 wherein said first fitting is a three-way fitting having a pair of sockets oriented in a given direction and a branch socket that is perpendicular to said given direction, and said second fitting is a four-way fitting having two pairs of sockets with each of the pairs of sockets being perpendicular to the other;

wherein the diametrically opposing holes on the end portions of the union are located on diameters thereof that are at a predetermined angle with respect to each other;

wherein the unitary structure so formed has five external sockets thereon that are oriented in one pattern when one of the pair of sockets of the three-way fitting is aligned with and joined to a socket of the four-way fitting, and are oriented in another pattern when the branch socket of the three-way fitting is aligned with and joined to a socket of the four-way fitting; and wherein the sockets of the three-way and four-way fittings that are perpendicular to the aligned sockets thereof are offset from each other and when viewed from the end of the aligned sockets are oriented at an angle relative to each other corresponding to the angle at which the diameters of the diametrically opposing holes on the end portions of the union are located relative to each other.

8. The combination as recited in claim 2 wherein both said first and second fittings are three-way fittings, each fitting having a pair of sockets oriented in a given direction and a branch socket that is perpendicular to the given direction;

wherein the diametrically opposing holes in the end portion of the union are located on diameters that are at a predetermined angle with respect to each other;

wherein the unitary coupling structure so formed has four external sockets thereon that are oriented in one pattern when one of the pair of sockets of the first three-way fitting is aligned with and joined to a branch socket of the second three-way fitting, oriented in another pattern when one of the pair of sockets of the first three-way fitting is aligned with and joined to one of the pair of sockets of the second three-way fitting, and oriented in still another pattern when the branch socket of the first three-way fitting is aligned with and joined to the branch socket of the second three-way fitting; and wherein the sockets of the first and second three-way fittings that are perpendicular to the aligned sockets thereof are offset from each other and when viewed from the end of the aligned sockets are oriented relative to each other at an angle at which the diameters of the diametrically opposing holes on the end portions of the union are located relative to each other.

9. A combination as recited in claim 2 wherein said first fitting is a three-way fitting having a pair of sockets oriented in a given direction and a branch socket that is perpendicular to said given direction, and said second fitting is an elbow fitting with one of the sockets thereof oriented in said given direction;

wherein the diametrically opposing holes on the end portion of the union are located on diameters thereof that are at a predetermined angle with respect to each other; and wherein the unitary structure so formed has three external sockets thereon that are oriented in one pattern when said one socket of the elbow fitting is aligned with and joined by said union to one of the aligned sockets of the three-way fitting, and oriented in another pattern when said one socket of the elbow fitting is aligned with and joined by said union to the branch socket of the three-way fitting;

wherein the sockets of the three-way fitting and elbow fitting that are perpendicular to the aligned sockets thereof are offset from each other and when viewed from the end of the aligned sockets are oriented relative to each other at an angle at which the diameters of the diametrically opposing holes on the end portions of the union are located relative to each other.

* * * * *